US006126354A

United States Patent [19]

Ramich

[11] Patent Number: 6,126,354

[45] **Date of Patent: *Oct. 3, 2000**

[54] REUSABLE BINDING SYSTEM AND METHOD

[76] Inventor: Craig Ramich, 13162 Ashnut La., Herndon, Va. 20171

[ * ] Notice: This patent is subject to a terminal disclaimer.

[21] Appl. No.: 09/303,417

[22] Filed: May 3, 1999

Related U.S. Application Data

[63] Continuation of application No. 08/971,371, Nov. 17, 1997.

[51] Int. Cl.[7] ..... B42F 3/02

[52] U.S. Cl. ..... 402/46; 281/21.1; 281/28; 402/47; 402/52; 402/54

[58] Field of Search ..... 281/36, 15.1, 21.1, 281/28; 402/46, 47, 48, 49, 50, 52, 54, 55, 56

[56] References Cited

U.S. PATENT DOCUMENTS

| | | | |
|---|---|---|---|
| 1,550,050 | 8/1925 | Schade | 281/36 |
| 2,120,659 | 6/1938 | Wedge | 402/46 |
| 3,596,929 | 8/1971 | Abildgaard et al. | 281/21 |
| 4,120,517 | 10/1978 | Staats | 281/19 |
| 4,441,834 | 4/1984 | Cardellini | 402/55 |
| 4,625,996 | 12/1986 | Hymmen | 281/21 |
| 4,674,906 | 6/1987 | Abildgaard | 402/80 |
| 4,685,700 | 8/1987 | Abildgaard | 281/21 |
| 4,941,804 | 7/1990 | Sarpy, Jr. | 412/7 |
| 4,974,877 | 12/1990 | Azzato | 281/47 |
| 5,104,147 | 4/1992 | King | 281/21.1 |
| 5,338,125 | 8/1994 | Forsse et al. | 402/46 |
| 5,524,997 | 6/1996 | von Rohrscheidt | 402/19 |
| 5,618,122 | 4/1997 | Constantine | 402/22 |
| 5,626,432 | 5/1997 | Swift et al. | 402/8 |

*Primary Examiner*—Andrea L. Pitts
*Assistant Examiner*—Monica Smith Carter
*Attorney, Agent, or Firm*—Mathews, Collins, Shepherd & Gould, P.A.

[57] ABSTRACT

A system and method for binding documents wherein the binder is reusable and is easy to use, the binding system comprising interlocking pieces that combined form a secure and reusable document binder.

19 Claims, 6 Drawing Sheets

REUSABLE BINDING SYSTEM AND METHOD

This is a continuation of Ser. No. 08/971,371, filed Nov. 17, 1997.

The present invention relates to a binding system and method for retaining sheets of paper and the like.

BACKGROUND OF THE INVENTION

The use of reusable binders is well known. Conventional reusable bindings consist of one-piece binders which have a plurality of fingers that do not interlock or two-piece binding strips that incorporate locking studs and no spine. One-piece bindings generally incorporate a plurality of fingers that are inserted through holes punched along the margin of paper sheets. Using the resilient properties of the binding, the fingers are spread and inserted through the holes in the sheets. The spreading pressure is released and the fingers return to their original position, holding the paper sheets in place. These bindings are typically round in configuration and allow the document to be laid flat along a horizontal surface.

Two-piece binding strips typically require small holes to be punched along the margin of paper sheets. The studs of the male binding strip are inserted through the holes in the sheets. The extending portion of the stud is inserted through a female strip that has locking channels. The extending portion of the stud is manually bent into the locking channel to secure the paper sheets. These bindings have no spine and are difficult to lay flat along a horizontal surface.

Each of these binding systems has its disadvantages. The one-piece bindings require the use of a machine or similar apparatus to hold and spread the binding fingers. The round spine is not aesthetically pleasing and does not resemble traditionally-bound hard cover books or documents. If the binding is filled with an excessive number of paper sheets, the outer sheets can be released from the fingers. In addition, two-piece binding strips do not resemble bound documents. The binding can not be easily laid flat, and the reader is typically required to bend the paper sheets along the inside margin to open the document. Continued opening and closing of the document wears the paper margin such that the original shape of the document is no longer retained.

OBJECTS OF THE INVENTION

It is therefore an object of the present invention to provide a binding system and method that is reusable.

It is another object of the invention to provide a binding system and method that does not require the use of a machine to bind the sheets.

It is yet another object of the present invention to provide a binding system and method that produces a bound volume which can be laid open flat and still retain an aesthetically pleasing look.

It is still another object of the present invention to provide a two-piece binding system and method wherein the pages within the binder are not subject to excessive wear and tear.

It is still another object of the present invention to provide a binding system that easily enables pages to be added or removed without sacrificing the integrity of the binder.

SUMMARY OF THE INVENTION

Accordingly, the present invention comprises a system and method for binding documents wherein the binder is reusable and is easy to use.

The present invention provides two pieces of interlocking plastic that combined form a secure and reusable document binder. The binder comprises a spine piece, which can be rectangular-shaped or rounded, and a ring strip which comprises a supporting strip and at least one and preferably three to five pairs of fingers. The spine piece further comprises at least one and preferably three to five pairs of receiving slots and locking tabs for receiving the corresponding ends of each of the ring strip fingers. The ring strip fingers are curled and extend through the holes of the sheets to secure the sheets in the binder when locked into the receiving slots of the spine. The receiving slots further comprise small openings at select locations to facilitate disengagement of the locking tabs.

The present invention can be used to bind any material available in the form of a sheet including but not limited to paper, acetate, foil and polymer.

In one embodiment, the receiving slots further comprise a channel that corresponds to the size and shape of the ring strip finger ends. In one embodiment this channel is t-shaped, however the present invention contemplates other shapes as well. The locking tab is located within the slot and corresponds to a notch formed on the end of each of the ring strip fingers. In assembly, after the ring strip fingers are placed within the sheets to be bound, each pair of ring strip finger ends of the ring strip is matched to the corresponding pair of slots of the spine. The ring strip finger ends are then moved (slid) upward inside the receiving slots until the ends pass over the locking tabs.

In another embodiment the spine comprises two separate portions, each comprising finger end receiving slots which correspond to the finger end receiving slots of the other spine portion. In this embodiment the spine portions are engaged with the ring finger ends one at a time.

In another embodiment, the receiving slots have a direct perpendicular entry insertion point versus the channel-type sliding method described above. The female receiving slots of the spine comprise a flanged interior space that accepts the tab of the male ring strip finger ends. The interior space of the receiving slot is shaped to engage the finger ends and may be v-shaped, u-shaped or any other appropriate shape that accommodates a similarly shaped and sized male ring strip finger end. The wider portion of the finger end is force-fit past the flange of the receiving slot and into the void space of the receiving slot, thus engaging the flange of the slot with the tab of the finger end and preventing the finger end from being released.

The present invention also relates to a process of document binding where holes are punched into sheets of paper or the like at the margin, said holes preferably corresponding to the orientation, number and shape of the ring strip fingers. Preferably, a cutting die fashioned in the orientation of the ring strip fingers is combined with manually- or mechanically-applied pressure such that the die cuts through each underlying sheet. Depending on the number of sheets to be punched, a locking mechanism may be used that holds the sheets in place thereby allowing the die pressure to be more evenly distributed across the sheet margin and reducing the potential for sheet movement during punching.

The present invention has several advantageous features. The spine closely resembles the spine of traditionally-bound hard cover books and allows the bound document to be placed flat on a horizontal surface for ease of reading. Printing or other forms of identification can be easily applied to the spine. The locking mechanism is unique in that it allows the document to be bound manually once holes are punched into the sheets. The binding is also reusable, as small holes are located at specific locations which allow the locking tabs to be released. The secure nature of the binding prevents the unintentional loss of sheets while the releasable locking tabs allow easy insertion of additional pages.

Other features and advantages of the present invention will become apparent from the following description of the invention which refers to the following figures.

DESCRIPTION OF PREFERRED EMBODIMENTS

Figure 1:
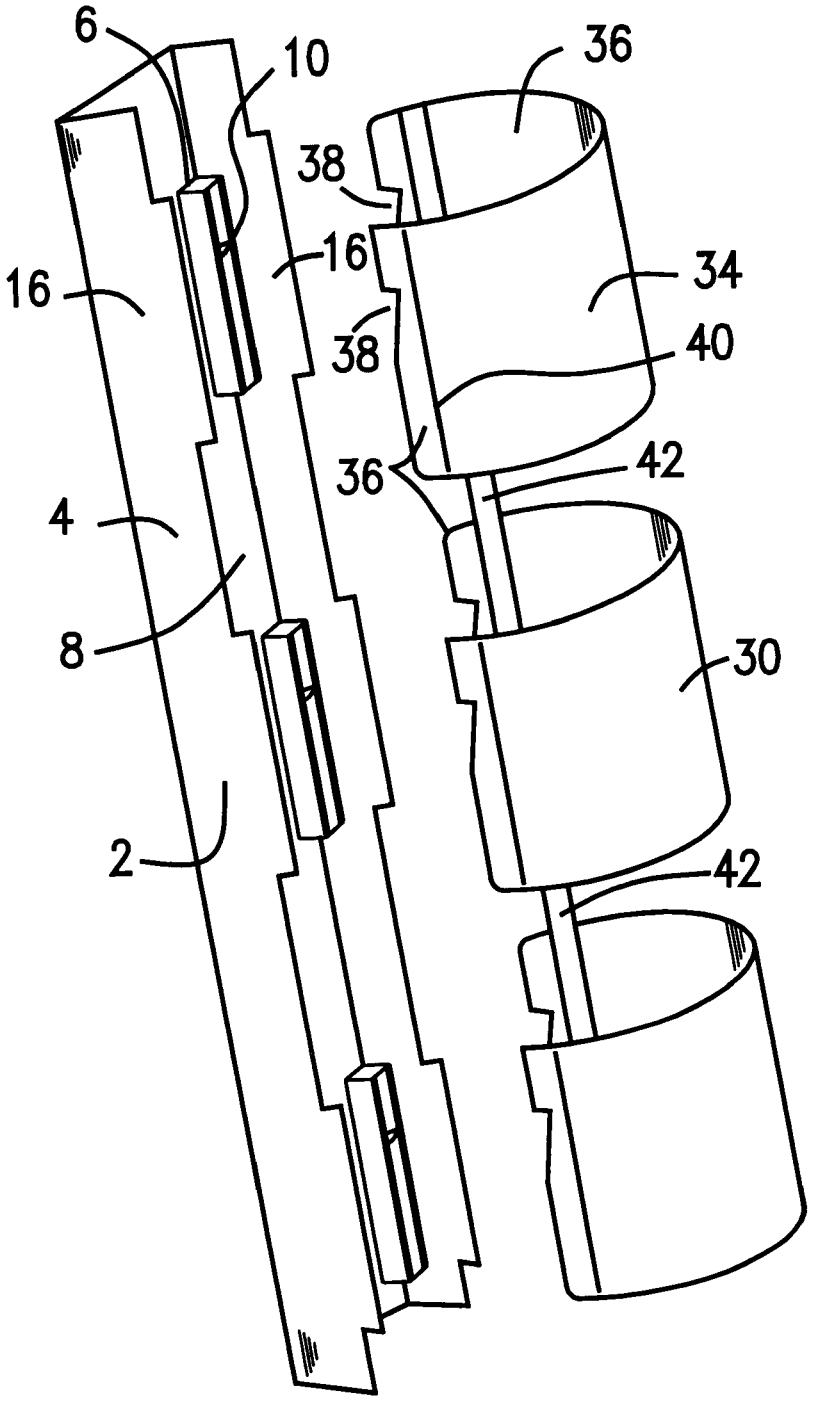
FIG. 1 is a perspective view of one of the embodiments of the binding system in accordance with the present invention.

A typical application of the present invention is shown in FIGS. 1–4*a* and 6. The binding system comprises primarily two portions: a spine 2 and a ring strip 30. The spine 2 further comprises an elongated dorsal portion 4 having at least one pair of receiving slots 6 formed on a receiving side 8 of said dorsal portion 4. In a preferred embodiment, the spine 2 comprises at least three pairs of receiving slots 6, said pairs of slots 6 oriented such that a first slot of each pair is aligned linearly with the first slot of an adjacent pair on one perimeter of the receiving side 8 along the longitudinal axis of said dorsal portion and the second slot of each pair is aligned opposite the first slot of each pair, each of said second slots being formed along the opposite perimeter of the receiving side 8. Though the receiving slots are shown in a parallel configuration to the length of the spine, they may be oriented in a different fashion (i.e., a perpendicular configuration).

In another embodiment, not shown, the spine 2 may further comprise more than one piece. Spine 2 may comprise two dorsal portions 4, each having a row of receiving slots 6. Alternatively, spine 2 may comprise a plurality of short spines, each having a single pair of receiving slots.

Figure 2:
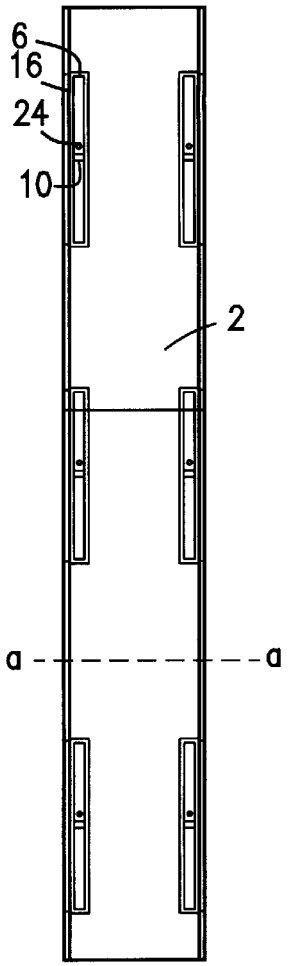
FIG. 2 is a plan view of the spine of the present invention according to FIG. 1.
Figure 2B:
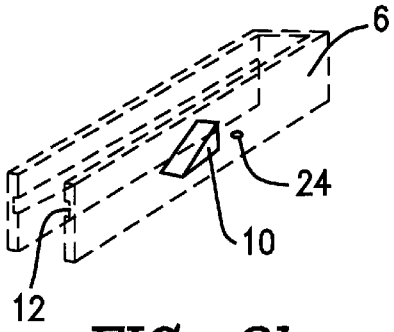
FIG. 2*b* is an enlarged detailed perspective view of the receiving slot of FIG. 2.
Figure 3:
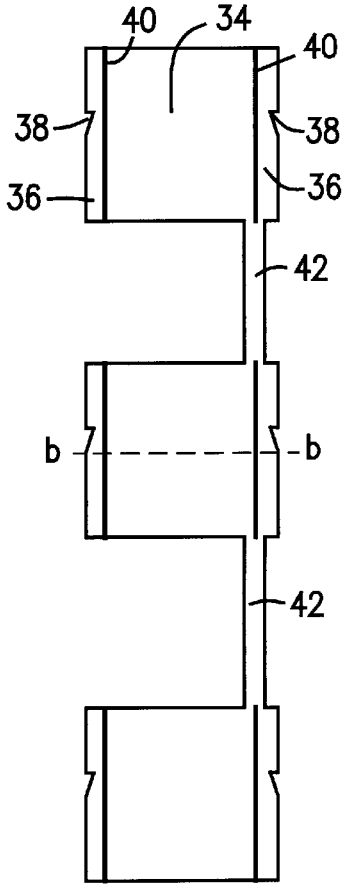
FIG. 3 is a plan view of the ring strip of the invention according to FIG. 1.

Within each slot 6, approximately two-thirds along its length, are locking tabs 10, which in the embodiment shown in FIG. 2*b* are triangular in shape but may be shaped in any manner that will achieve the locking method of the present invention. Now referring to FIG. 2*b*, the interior sides of the spine receiving slots 6 contain channels 12. For minimizing raw material use and aesthetic purposes in a preferred embodiment the inner edge of the spine 2 is tabbed 14 to allow the sheets 16 to be more easily laid flat and provide an integral appearance to the binder. The configuration of the spine edges can be shaped differently for functionality or aesthetics. In addition, referring for example to FIG. 3*b*, the ring strip fingers 34 can be shaped to promote appearance and function.

Figure 3A:
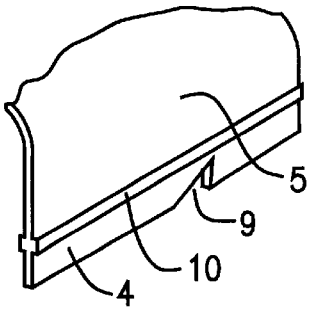
FIG. 3*a* is an enlarged detailed perspective view of the finger end of the invention according to FIG. 3.
Figure 2A:
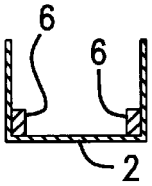
FIG. 2*a* is a cross sectional view of the spine of the present invention through line a—a of FIG. 2.
Figure 3B:
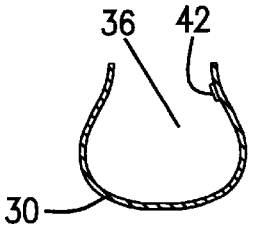
FIG. 3*b* is a cross sectional view of the ring strip of the present invention along line b—b of FIG. 3.
Figure 4:
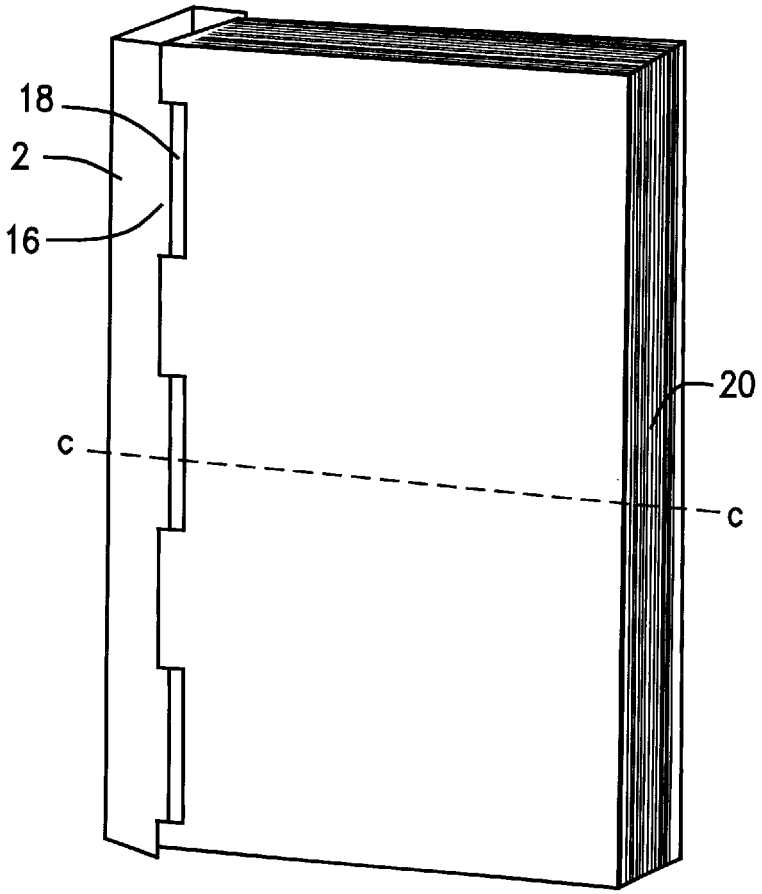
FIG. 4 is a perspective view of the embodiment of FIG. 1, wherein the binder is shown securing together a stack of sheets.
Figure 4A:
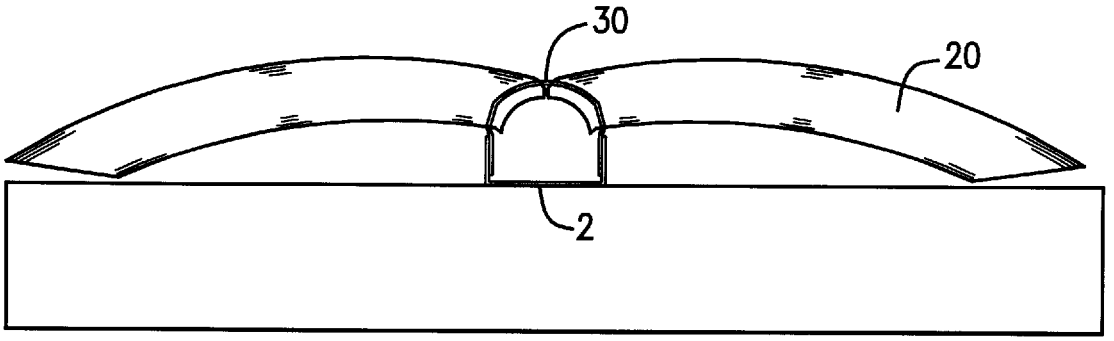
FIG. 4*a* is a cross sectional view of the embodiment of FIG. 4 through the line c—c of FIG. 4 when the bound stack of sheets is in an open position.
Figure 5:
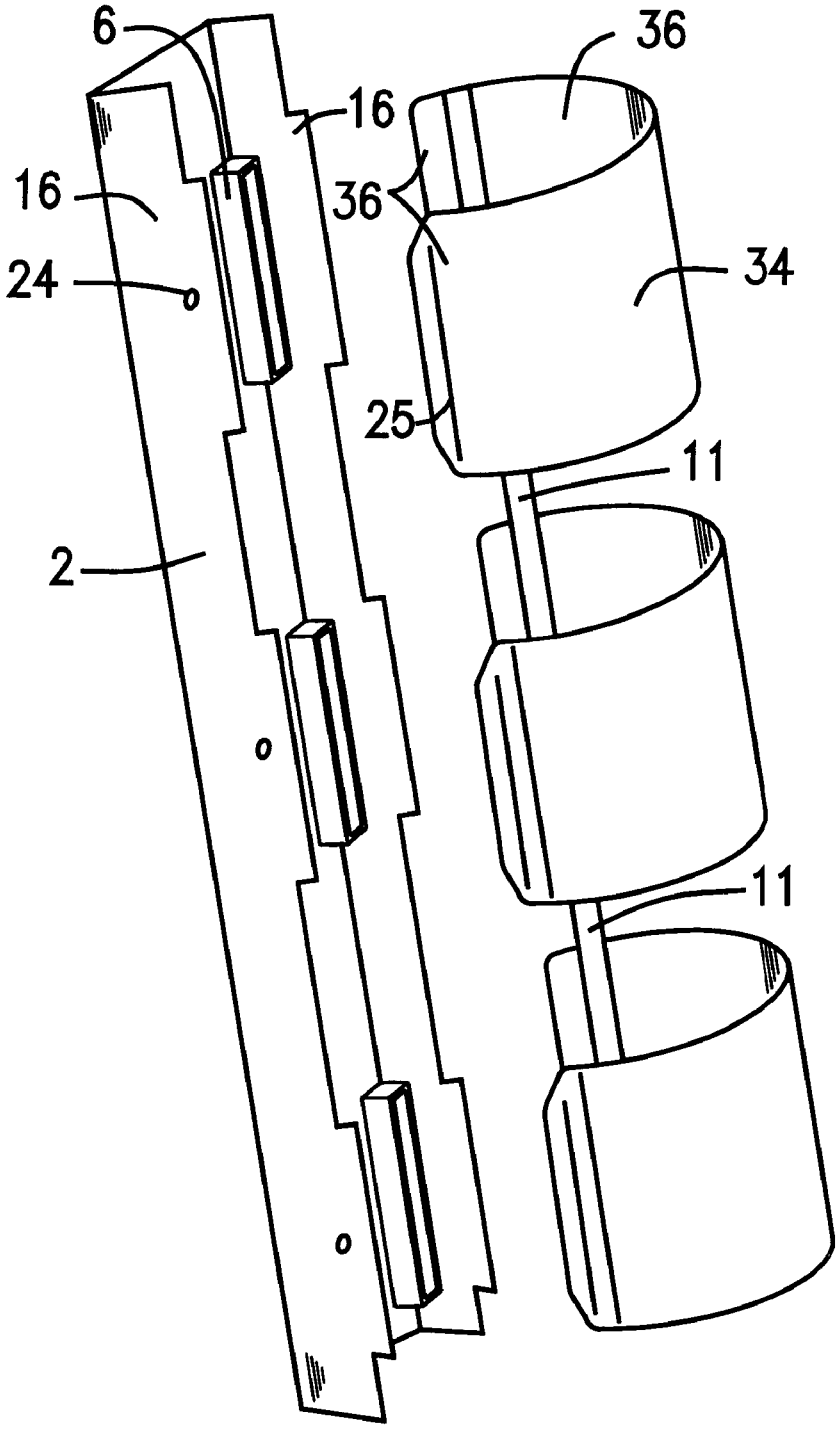
FIG. 5 is a perspective view of an alternate embodiment of the binding system in accordance with the present invention.
Figure 6:
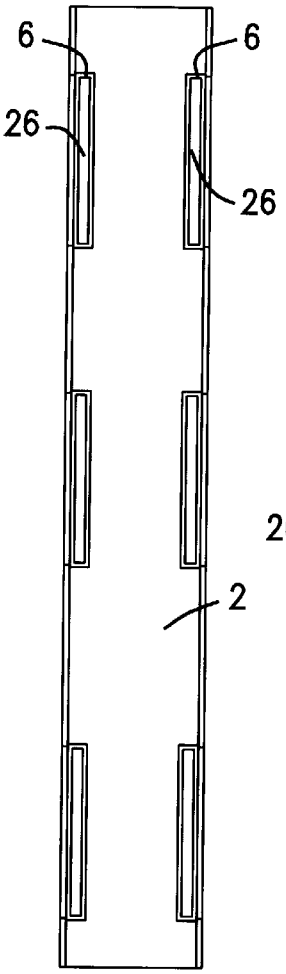
FIG. 6 is a plan view of the spine of the embodiment shown in FIG. 5.
Figure 6A:
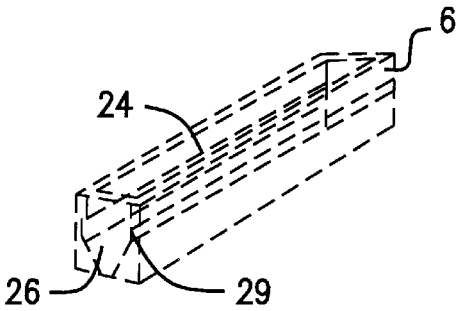
FIG. 6*a* is an enlarged detailed perspective view of the receiving slot of FIG. 6.

The ring strip 30 comprises a supporting strip 32 having at least one finger 34 attached thereto that may be curved to form a ring 31. The supporting strip 32 maintains the fingers 34 in the proper orientation to the receiving slots 6 and facilitates easy handling of the ring strip. In a preferred embodiment the ring strip 30 comprises at least three rings 31. Each finger 34 has two ends 36, each end 36 comprising a locking notch 38 and guide 40 that corresponds to and slidably engages a spine receiving slot 6 and channel 12 and locks said slot 6 and finger ends 36 together as locking notch 38 passes over locking tab 10. As best seen in FIG. 3*a* the locking notch 38 in this embodiment is triangular in shape to accommodate the locking tab 10 shown in FIG. 2*b*, but will vary in shape in actual use depending on the shape of the locking tab 10. For example, the locking tab 10 may comprise a semisphere formed within the slot 6 and the notch 38 may comprise a corresponding depression formed along the surface of the finger end 36.

Similarly, the respective t-shapes of the channel 12 and the guide 40 as shown in FIGS. 2*b* and 3*a* are merely illustrative and may take many forms. Moreover, while FIGS. 3 and 3*a* show guide 40 formed along the length of finger 34, guide 40 may extend only partially along the length of finger 34.

In a preferred embodiment the locking notch 38 and locking tab 10 are formed from a resilient material such as plastic enabling the tab 10 and/or notch 38 to deform to achieve the locking position.

A document is bound when retaining apertures or holes 18 are punched in sheets 16 using cutting dies 20 oriented to the size, shape, and spacing of the ring strip 30 and its fingers 34. If necessary, a sheet locking bar 22 or similar holding mechanism known in the art is used to hold the sheets 16 in place during punching, allowing a more even distribution of cutting pressure.

Once the holes 18 are punched, the ring strip fingers 34 are inserted into the holes 18 of the sheets 16. With the ring strip 30 and the inserted sheets 16 held together, the finger ends 36 are aligned with the receiving slots 6. In an upward motion along the longitudinal axis of the spine 2, the finger ends 36 are slidably engaged within the slots 6 such that the guides 40 slide within the channel 12. The upward motion is continued until the locking notch 38 passes over the locking tab 10. After the notches 38 are securely positioned within the tabs 10, the binder cannot be separated by applying opposite or perpendicular pressure.

In a preferred embodiment the binder is reusable. A method for separating the binder is provided wherein separation of the spine 2 and the ring strip 30 is achieved by inserting a small cylindrical item (not shown) such as a pen tip into the tab release holes 24 thereby pushing the notch 38 over the locking tab 10. This procedure allows the locking means to be disengaged and binder separation is achieved by applying opposite pressure on the ring strip 30.

Figure 7:
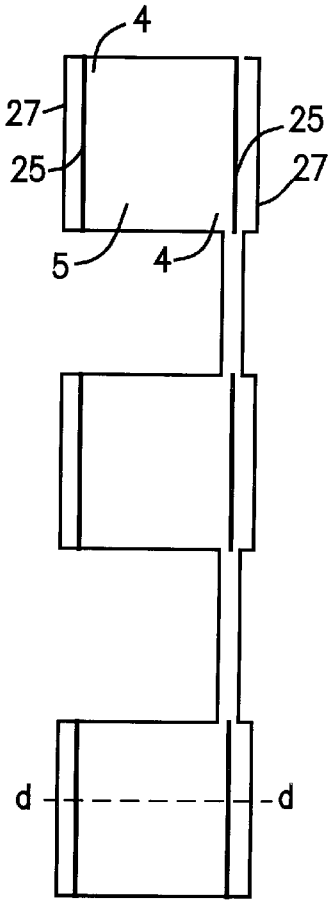
FIG. 7 is a plan view of the ring strip of the embodiment shown in FIG. 5.
Figure 7A:
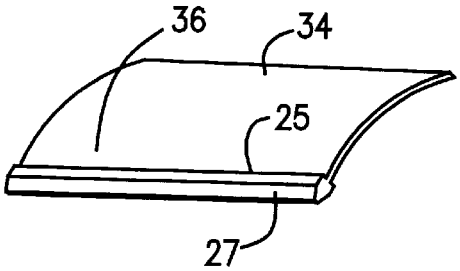
FIG. 7*a* is an enlarged detailed perspective view of the finger end of the invention according to FIG. 7.
Figure 7B:
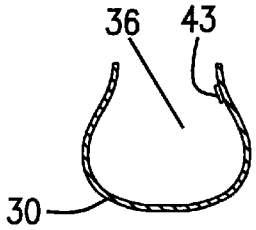
FIG. 7*b* is a cross sectional view of the ring strip of the embodiment of the invention according to FIG. 7 along line d—d of FIG. 7.
Figure 8:
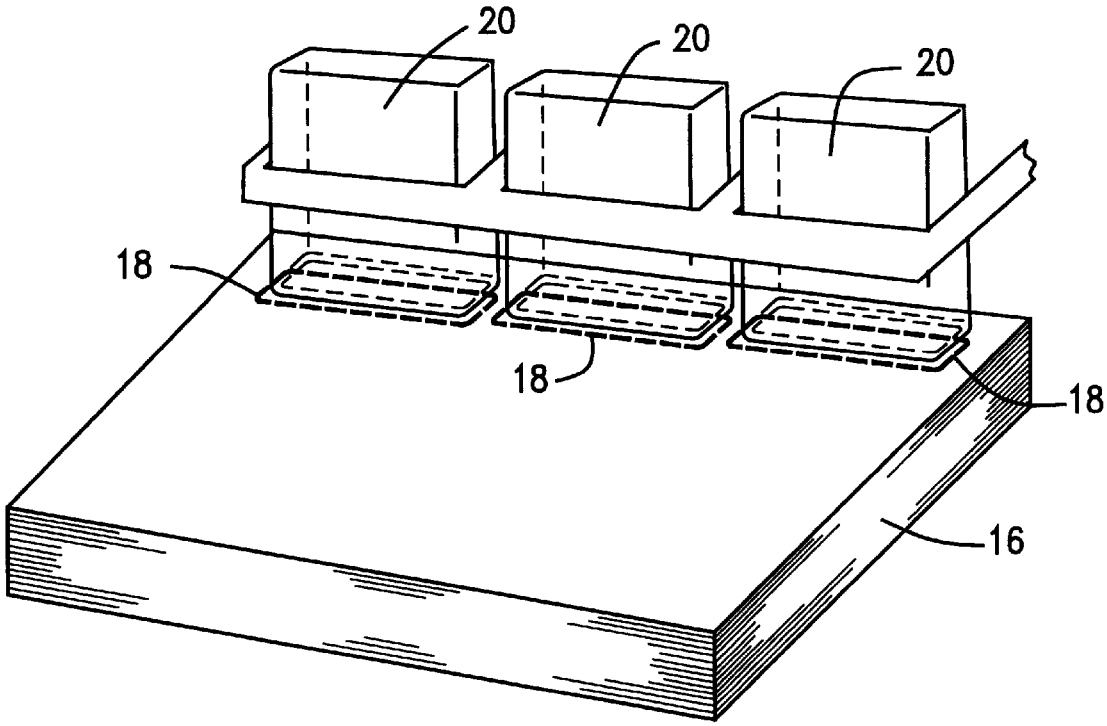
FIG. 8 is a perspective view of one embodiment of the binding process of the present invention.

A most preferred embodiment of the present invention is shown in FIGS. 5–8. In this embodiment the binding system comprises v-shaped slots 50 and finger ends 36 comprising v-shaped locking tabs 52, as best shown in FIG. 7*a*. The v-shaped slots 50 accept the v-shaped tabs 52 of the ring strip finger ends 36. The wide portions 54 of the v-shaped locking tabs 52 are compressed into the corresponding slots 50 during insertion which prevents the ends 36 from being released.

In this embodiment, to bind the document after the appropriate number of holes are punched, the ring strip fingers 34 are inserted into the punched holes 18 of the sheets 16. With the ring strip 30 and the inserted paper sheets 16 held together, the finger ends 36 are aligned with the v-shaped receiving slots 50. The v-shaped locking tabs 52 of the finger ends 36 are then inserted by snap-fit into the slots 50 such that the v-shaped tabs 52 slide within the v-shaped slot 50, the upper edges 56 of the slot 50 resiliently widening as wide portion 54 of the locking tab is inserted, and upper edges 56 subsequently returning to their original orientation as wide portion 54 is engaged and locked within slot 50. After the tabs 52 are securely positioned within the slots 50, the binder cannot be separated by applying opposite or parallel pressure.

This embodiment also is reusable and employs tab release holes 60. The spine 2 and ring strip 30 are separated by inserting a small cylindrical item (not shown) such as a pen tip into the tab release holes 60 thereby compressing the wide portion 54 of the tab 52 to the width of the receiving slot 50. This procedure allows the finger ends 36 to be withdrawn from the slot 50 by applying opposite pressure on the ring strip 30.

Figure 9:
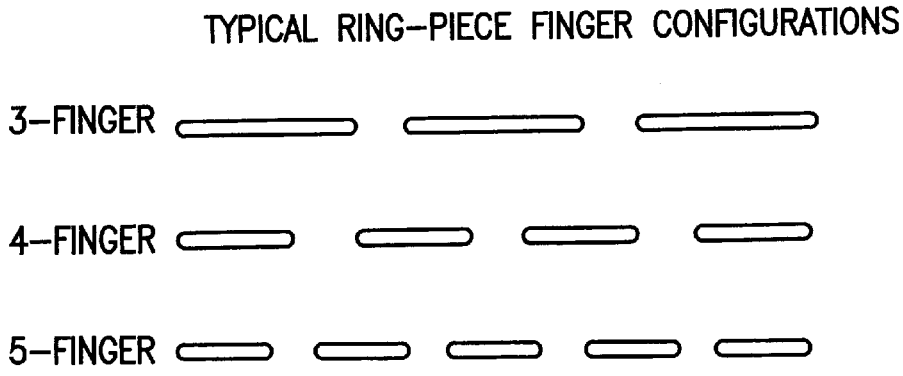
FIG. 9 is a plan view of examples of alternative sheet hole orientations for the binding system of the present invention.

Although the descriptions above contain several specificities, these should not be construed as limiting the scope of the present invention but merely illustrative. For example, where a certain number of fingers are shown in the illustrations, a smaller or larger number of fingers may be used (FIG. 9), or the fingers may be shaped differently, while retaining the locking features.

From the foregoing, it is seen that this invention is one well adapted to attain all the ends and objectives hereinabove set forth together with other advantages which are inherent in the structure.

While the invention has been practically shown, described and illustrated in detail with reference to the preferred embodiments and modifications thereof, it should be understood by those skilled in the art that equivalent changes in form and detail may be made therein without departing from the true spirit and scope of the present invention as claimed, except as precluded by the prior art.

What is claimed is:

1. A binding system for binding a plurality of sheets comprising:

an elongated spine comprising at least one pair of receiving slots formed on a first side of said spine, wherein said slots are spaced apart along opposite perimeters of said first side, said slots further comprising a locking means; and a strip comprising at least one finger extending from said strip for insertion into an aperture formed in at least one sheet to be bound, said finger comprising two ends and attached to said strip at a point between said ends, said ends further comprising a means for engaging said locking means of said slots.

2. The binding system according to claim 1 wherein said binding system is fabricated from a resilient material.

3. The binding system according to claim 1 wherein said binding system is fabricated from plastic.

4. The binding system according to claim 1 wherein said locking means is at least one locking tab formed within said slots.

5. The binding system according to claim 4 wherein said slots further comprise a pair of opposite facing interior walls having at least one channel formed in at least one of said interior walls for receiving said engaging means of said finger ends.

6. The binding system according to claim 5 wherein said engaging means further comprises a guide shaped to conform to an interior space of said channel.

7. The binding system according to claim 6 wherein said engaging means further comprises a locking notch.

8. The binding system according to claim 7 wherein said guide slidably engages said channel and said locking notch engages said locking tab.

9. The binding system according to claim 8 further comprising a means for releasing said locking tab from engagement with said locking notch.

10. The binding system according to claim 9 wherein said means for releasing said locking tab from engagement with said locking notch is a tab release hole formed within said slot.

11. The binding system according to claim 1 further comprising a means for releasing said engagement means from said locking means.

12. The binding system according to claim 1 wherein said locking means is an edge formed in said slot and said engaging means is a corresponding space formed in said ends for receiving said edge, said engaging means engaging said edge when said ends are snap-fit into said slots.

13. The binding system according to claim 12 further comprising a means for releasing said ends from said slots.

14. The binding system according to claim 12 wherein said binding system is fabricated of resilient material.

15. The binding system according to claim 12 wherein said binding system is fabricated from plastic.

16. A method for binding sheets comprising the steps of:

providing an elongated spine comprising at least one pair of receiving slots formed on a first side of said spine, wherein said slots are spaced apart along opposite perimeters of said first side said slots further comprising a locking means;

providing a strip comprising at least one finger extending from said strip for insertion into an aperture formed in all sheets to be bound, said finger comprising two ends and attached to said strip at a point between said ends, said ends further comprising a means for engaging said locking means of said slots;

forming in all sheets to be bound at least one receiving aperture;

inserting said fingers through the apertures of said sheets to be bound; and inserting said finger ends into said slots.

17. The method according to claim 16 further comprising providing means for releasing said engagement means from said locking means.

18. The method according to claim 16 further comprising fabricating said binding system from resilient material.

19. The method according to claim 16 wherein said resilient material is plastic.

* * * * *